US006101259A

United States Patent [19]

Rapps

[11] Patent Number: 6,101,259

[45] Date of Patent: Aug. 8, 2000

[54] BEHIND THE EAR COMMUNICATION DEVICE

[75] Inventor: Gary M. Rapps, Sunrise, Fla.

[73] Assignee: Motorola, Inc., Schaumburg, Ill.

[21] Appl. No.: 09/128,006

[22] Filed: Aug. 3, 1998

[51] Int. Cl.[7] ..... H04R 25/00

[52] U.S. Cl. ..... 381/330; 381/381; 181/129; D24/174

[58] Field of Search ..... 381/330, 312, 381/322, FOR 134, 395, FOR 127, FOR 132, FOR 135, 381, 327; 181/128, 129; 379/430; D24/174

[56] References Cited

U.S. PATENT DOCUMENTS

| | | | |
|---|---|---|---|
| D. 294,862 | 3/1988 | Diefenbach | D24/174 |
| 2,474,135 | 6/1949 | White | 381/330 |
| 3,667,569 | 6/1972 | Mackey et al. | 381/330 |
| 4,291,203 | 9/1981 | Bellafiore | 381/327 |
| 4,727,582 | 2/1988 | De Vries et al. | 381/330 |
| 4,783,816 | 11/1988 | Buttner et al. | 381/330 |
| 4,917,504 | 4/1990 | Scott et al. | 381/330 |
| 5,062,138 | 10/1991 | Schmid | 381/330 |
| 5,249,234 | 9/1993 | Butler | 381/330 |
| 5,341,433 | 8/1994 | Meyer et al. | 381/330 |
| 5,412,736 | 5/1995 | Keliiliki | 381/330 |
| 5,659,156 | 8/1997 | Mauney et al. | 181/130 |
| 5,694,475 | 12/1997 | Boyden | 381/327 |

*Primary Examiner*—Forester W. Isen
*Assistant Examiner*—Xu Mei
*Attorney, Agent, or Firm*—Andrew S. Fuller

[57] ABSTRACT

A behind the ear communication device (200) has a housing (205) with a form factor to provide a comfortable fit across a wide variety of users. Particularly, the housing (205) is a hook shaped member having an inner curved surface (261) defined by first and second arcs (272, 271) that merge, in tangential fashion, to form a contiguous surface for interfacing with the ear. The first arc (272) has a radius of between 0.826 and 0.876 centimeters, and the second arc has a radius of between 3.24 and 3.75 centimeters.

13 Claims, 3 Drawing Sheets

BEHIND THE EAR COMMUNICATION DEVICE

TECHNICAL FIELD

This invention relates in general to communication devices, and more particularly, communication devices intended to be worn by a user behind the ear.

BACKGROUND OF THE INVENTION

Communication devices intended to be worn by a user behind the ear (BTE devices) can be found in many forms. One popular construction is to have a hook shaped member having a main portion that houses device electronics, and a sharply curved portion that hooks around the helix of the ear to provide a conduit for sound to the ear canal. An important aspect in any BTE device is that of fit for comfortable long term use. One approach to providing a proper fit is to make BTE devices available in a variety of sizes, such that a user may select an appropriate size. Another approach is to custom fit the BTE device for a particular user. Yet another approach is to make a single size BTE device that represents a compromise in terms of comfort and fit.

For mass market applications, a one size fits all approach yields substantial manufacturing and distribution cost advantages. However, because ears come in a variety of shapes and sizes, many users of current single size BTE devices suffer in comfort because the form factor provides a poor fit. It is desirable to have form factor for a BTE device that provides a comfortable fit across a wide variety of users, and therefore, a new behind the ear communication device is needed.

DETAILED DESCRIPTION OF THE PREFERRED EMBODIMENT

Figure 1:
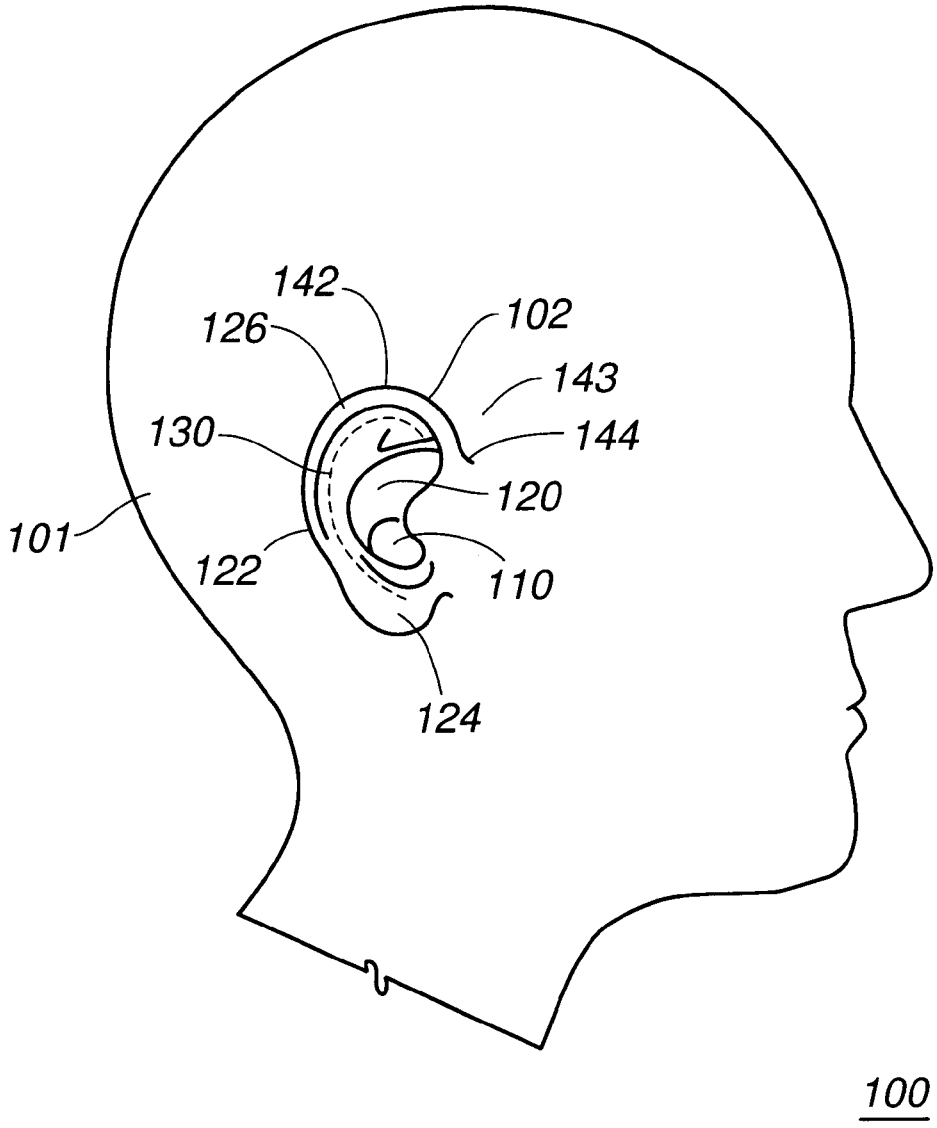
FIG. 1 is a side view of a human head and ear.

While the specification concludes with claims defining the features of the invention that are regarded as novel, it is believed that the invention will be better understood from a consideration of the following description in conjunction with the drawing figures, in which like reference numerals are carried forward.

The present invention provides for a behind the ear (BTE) communication device having a form factor that delivers a comfortable fit across a wide variety of users. The form factor stems from a discovery, through anatomic experiments, of a common ear contact surface configuration, formed using tangential arcs, that provides universal comfort and fit for ears of different shapes and sizes, across a major portion of the population. Particularly, the communication device has a hook shaped housing member having an inner surface defined by first and second arcs that merge, in tangential fashion, to form a contiguous surface for interfacing with the sulcus of the ear. The first arc has a radius of between 0.826 and 0.876 centimeters, and the second arc has a radius of between 3.24 and 3.75 centimeters. A common ear contact surface extends for a curve length of between 2.43 and 2.95 centimeters, and incorporates portions of the first and second arcs.

In FIG. 1, a view 100 shows the side of a typical human head 101 and outer ear 102 for the purpose of establishing reference elements. The ear 102 has a canal 110 that extends inwardly to an eardrum, and a pinna 122, which is a cartilaginous appendage that projects in an outward manner. The pinna has a cavity 120, along a front section 143 of the ear, referred to as a concha, that forms a conduit for sound to the ear canal 110. The pinna 122 includes a lobe 124 situated below the canal 110, and a helix 126 joined to the lobe 124 and forming an inwardly curving rim that forms the periphery of the concha. The helix extends from the earlobe 124 upwardly to a crest, i.e., the top portion 142 of the outer ear that curves downwardly to an attachment point 144 on the head. The groove or portion of the ear 130 behind the helix on the backside of the pinna that attaches the ear to the remainder of the head 101 is referred to as the sulcus.

Figure 2:
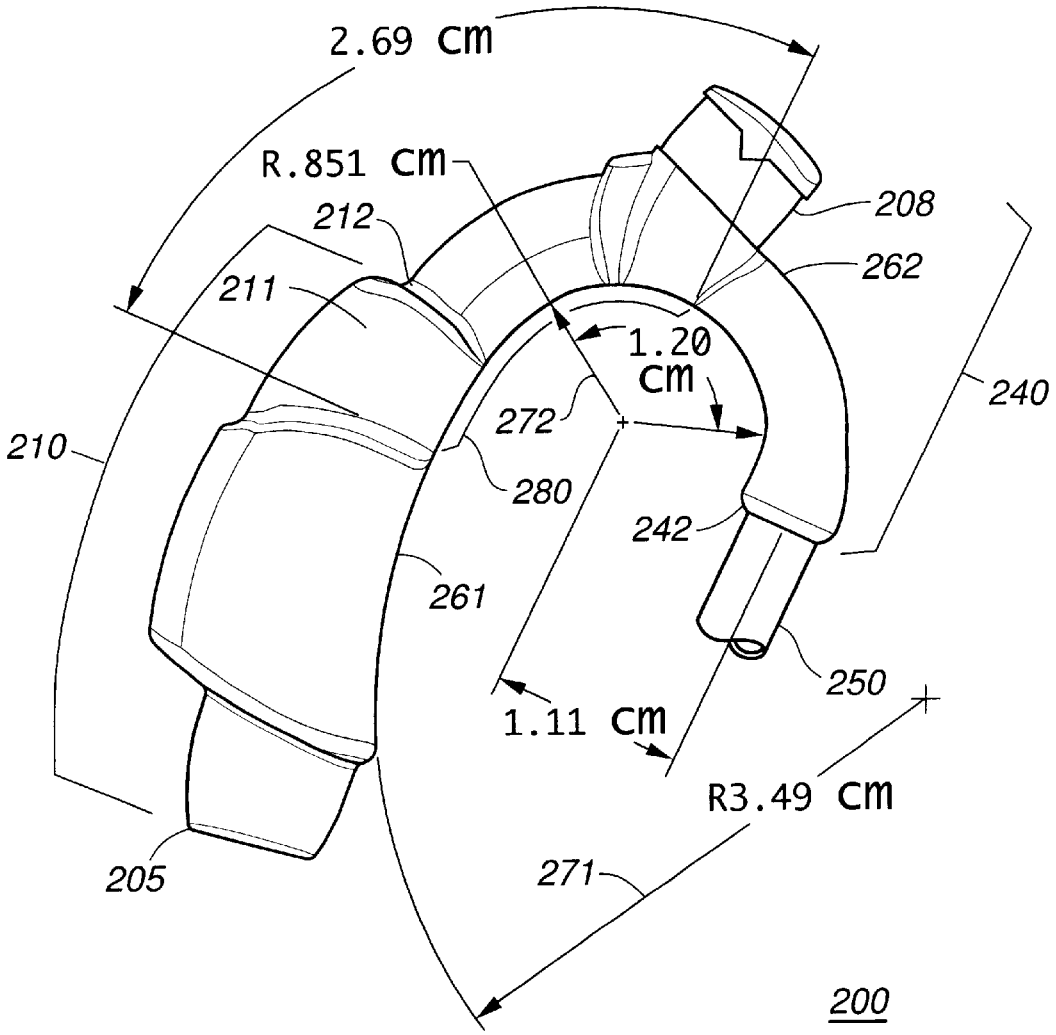
FIG. 2 is a side view of a behind the ear communication device showing significant dimensions, in accordance with the present invention.

FIG. 2 shows a profile view of a communication device 200 in which dimensions significant to the present invention are highlighted. The communication device 200 comprises a hooked shaped housing 205 having a form factor to fit around the typical human ear. A main portion 210 of the housing 205 houses device electronics (not shown) that receive and process audio signals. A tubular portion 240 of the housing extends from the main 210 portion and curves in a hook like manner for fitting around the top and front portions of the ear. The tubular portion 240 has a terminal end 242 that functions as a receptacle or tube mount for an attached sound delivery tube 250. The sound delivery tube 250 is pivotable about the terminal end 242 of the tubular portion 240 to accommodate left and right ear use, and angular corrections to match a user's ear canal axis.

The housing 205 has a concave "inner" surface 261 that fits behind and around a user's outer ear, i.e., the inner surface is that part of the exterior surface of the housing that abuts or makes contact with the sulcus 130 of the ear. A first part of the concave inner surface extends along the main portion and a second part of the concave inner surface extends along the tubular portion of the housing. Through extensive experiments, it was discovered that a particular dimensional configuration of the concave inner surface provides an exceptionally comfortable fit across a wide variety of users. Specifically, the concave surface 261 has a curvature defined by first and second arcs 272, 271 that tangentially intersect or merge to form a contiguous surface. The first arc 272 has a radius of between 0.826 and 0.876 centimeters, with a preferred radius of 0.851 centimeters. The second arc 271 has a radius of between 3.24 and 3.75 centimeters, with a preferred radius of 3.49 centimeters. A significant aspect of the concave inner surface is a universal fit portion 280 having a curve length of between 2.43 and 2.95 centimeters, with a preferred curve length of 2.69 centimeters, that includes a portion the first arc of approximately 1.20 centimeters in circumferential length, and a portion of the second arc of approximately 1.49 centimeters in circumferential length.

In the preferred embodiment, the first arc 272 extends from a point close to the terminal end 242 of the tubular portion 240 toward the main portion 210 of the housing for a circumferential length of between 1.08 and 1.33 centimeters. The second arc 271 extends, from the termination point of the first arc, for a circumferential length of between 1.36 and 1.61 centimeters, and has a radius of between 3.43 and 3.56 centimeters. The first arc 272 seamlessly integrates with the second arc 271 to produce a smooth continuously curved surface. Preferably, the center of the first arc is located approximately 1.11 centimeters from an axis extending along the sound delivery tube 250 through the terminal end 242.

In addition to the dimensional aspects of the curved inner surface, the communication device 200 also includes an eyeglass frame retainer area 211 formed as a recess with a ledge area 212 on the housing 205 near to the point of merger between the first and second arcs. Further, a microphone port 208 is formed on an outer surface 262 of the communication device, i.e., the surface opposite the concave inner surface 261. The microphone port 208 is located on the hook portion 240 of the housing 205, and is positioned such that when the communication device is fitted around the user's ear, the microphone port 208 is directed toward the user's mouth.

Figure 3:
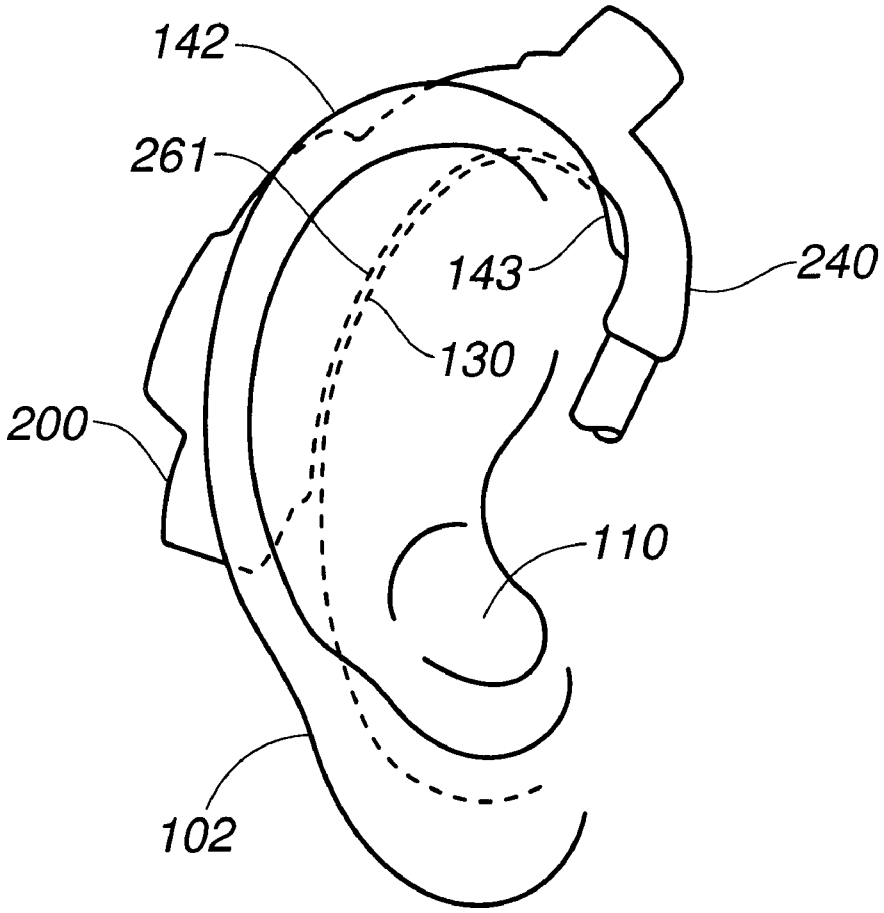
FIG. 3 shows the communication device fitted around the ear, in accordance with the present invention.

FIG. 3 shows the communication device 200 fitted behind the ear 102. The communication device 200 fits behind the ear such that the concave inner surface 261 makes contact with the back 130 of the ear 102, and the hook portion 240 curves around the top and front portions 142, 143 of the ear, such that the terminal end 242 and sound delivery tube 250 are directed toward the ear canal 110. The common contact surface 280 is well suited for fitting to the curvature of different types of ears. It is expected that the communication device may be angled differently for different types of ears, but that the contact area 280 will be common for the vast majority of users, thereby providing a universal fit.

The present invention provides significant advantages over the prior art. The dimensional characteristics of the inner concave contact surface differentiates the communication device 200 from prior art behind the ear communication devices, and provides superior comfort and fit across a wider of users.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A communication device for use behind an ear, comprising a housing containing device electronics that receive and process audio signals, the housing having a curved surface for contacting behind the ear, the curved surface having a portion of curve length of between 2.43 and 2.95 centimeters, which portion has a curvature defined by first and second arcs that tangentially intersect, the first arc having a radius of between 0.826 and 0.876 centimeters, and the second arc having a radius of between 3.24 and 3.75 centimeters.

2. The communication device of claim 1, wherein the first arc has a radius of 0.851 centimeters, and the second arc has a radius of 3.49 centimeters.

3. The communication device of claim 1, wherein the housing has a hook shaped housing portion having a tubular construction for sound delivery to the ear, wherein the hook shaped housing portion defined by the first arc and having a circumferential length of approximately 1.20 centimeters.

4. A communication device for use behind an ear, comprising a housing having a concave surface for abutting the ear, the concave surface having a first portion that defines a first arc of between 1.08 and 1.33 centimeters in circumferential length, the first arc having a radius of between 0.826 and 0.876 centimeters.

5. The communication device of claim 4, wherein the first arc has a radius of 0.851 centimeters.

6. The communication device of claim 4, wherein the concave surface further comprises a second portion defining a second arc having a radius of between 3.24 and 3.75 centimeters.

7. The communication device of claim 6, wherein the second arc has a radius of between 3.43 and 3.56 centimeters.

8. The communication device of claim 6, wherein the second are has a radius of 3.49 centimeters.

9. The communication device of claim 6, wherein the first arc seamlessly integrates with the second arc to produce a continuous curved surface having a length of between 2.44 and 2.95 centimeters.

10. A communication device for use behind a user's outer ear, the ear having top and front portions, a helix, and a sulcus, the communication device comprising:

a first housing portion having a tubular construction for sound delivery to the ear, the first housing portion a hook shape for fitting around the top and front portions of the ear, the first housing portion having an inner surface defined by a first arc having a radius of between 0.826 and 0.876 centimeters; and a second housing portion having an inner surface defined by a second arc having a radius of between 3.24 and 3.75 centimeters;

wherein the first and second arcs merge to form a contiguous inner surface, with respect to the first and second housing portions, for interfacing with the sulcus of the ear.

11. The communication device of claim 10, further comprising an eyeglass frame retainer area formed near to a point of merger between the first and second arcs.

12. The communication device of claim 10, further comprising a microphone port formed on the first housing portion.

13. The communication device of claim 10, wherein the first housing portion terminates to form a tube mount, and the first arc extends to the tube mount.

* * * * *